US005822890A

United States Patent [19]

Beitel et al.

[11] Patent Number: 5,822,890

[45] Date of Patent: Oct. 20, 1998

[54] SHOE WITH REPLACEABLE TRACTION NUBS

[76] Inventors: Michael Raymond Beitel; Leslie Joan Beitel, both of 86 Pereverzoff Place, Prince Albert, Saskatchewan, Canada, S6X-1B6

[21] Appl. No.: 929,411

[22] Filed: Sep. 15, 1997

[51] Int. Cl.[6] ..... A43B 15/16

[52] U.S. Cl. ..... 36/134; 36/67 D

[58] Field of Search ..... 36/134, 67 D

[56] References Cited

U.S. PATENT DOCUMENTS

| | | |
|---|---|---|
| 2,803,070 | 8/1957 | Passidomo et al. . |
| 3,054,197 | 9/1962 | Morgan et al. . |
| 5,617,653 | 4/1997 | Walker et al. . |

FOREIGN PATENT DOCUMENTS

| | | |
|---|---|---|
| 2644989 | 10/1990 | France . |
| 665969 | 9/1938 | Germany . |
| 4123302 | 1/1993 | Germany . |
| 509488 | 10/1937 | United Kingdom . |
| 659725 | 10/1951 | United Kingdom . |
| 2160146 | 12/1985 | United Kingdom . |
| 8606592 | 11/1986 | WIPO . |

OTHER PUBLICATIONS

Convertable Golf Shoe, American Shoemaking, Apr. 22, 1925, p. 21.

*Primary Examiner*—Ted Kavanaugh

[57] ABSTRACT

A shoe with replaceable traction nubs including a shoe comprised of an upper portion and a sole portion. The sole portion is disposed on a lower surface of the upper portion. The sole portion has a plurality of openings formed therein in a spaced relationship. A plurality of anchors are secured within the plurality of openings in the sole portion. A plurality of traction nubs are removably secured to the plurality of anchors. A tool is provided for installing and removing the plurality of traction nubs with respect to the plurality of anchors.

4 Claims, 2 Drawing Sheets

SHOE WITH REPLACEABLE TRACTION NUBS

BACKGROUND OF THE INVENTION

1. Field of the Invention

The present invention relates to a shoe with replaceable traction nubs and more particularly pertains to allowing proper traction to be maintained throughout a life of the shoe with a shoe with replaceable traction nubs.

2. Description of the Prior Art

The use of foot wear is known in the prior art. More specifically, foot wear heretofore devised and utilized for the purpose of providing comfort to a wearer are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,293,701 to Sullivan; U.S. Pat. No. 5,410,823 to Iyoob; U.S. Pat. No. 4,330,950 to Reddlien; U.S. Pat. No. 4,299,038 to Epple; U.S. Pat. No. 4,875,300 to Kazz; and U.S. Pat. No. De. 306,517 to Whatley.

While these devices fulfill their respective, particular objective and requirements, the aforementioned patents do not describe a shoe with replaceable traction nubs for allowing proper traction to be maintained throughout a life of the shoe.

In this respect, the shoe with replaceable traction nubs according to the present invention substantially departs from the conventional concepts and designs of the prior art, and in doing so provides an apparatus primarily developed for the purpose of allowing proper traction to be maintained throughout a life of the shoe.

Therefore, it can be appreciated that there exists a continuing need for new and improved shoe with replaceable traction nubs which can be used for allowing proper traction to be maintained throughout a life of the shoe. In this regard, the present invention substantially fulfills this need.

SUMMARY OF THE INVENTION

In the view of the foregoing disadvantages inherent in the known types of foot wear now present in the prior art, the present invention provides an improved shoe with replaceable traction nubs. As such, the general purpose of the present invention, which will be described subsequently in greater detail, is to provide a new and improved shoe with replaceable traction nubs and method which has all the advantages of the prior art and none of the disadvantages.

To attain this, the present invention essentially comprises a shoe comprised of an upper portion and a sole portion. The sole portion is disposed on a lower surface of the upper portion. The sole portion has a plurality of openings formed therein in a spaced relationship. A plurality of anchors are secured within the plurality of openings in the sole portion. Each of the anchors has a triangular shaped base secured within the openings. Each of the anchors has a coupling portion extending upwardly from the triangular shaped base. The coupling portion has a wide rounded lower portion and a tapered upper portion. The tapered upper portion has a threaded aperture formed within an upper end thereof. The upper end extends outwardly of the opening in the sole portion. A plurality of traction nubs are removably secured to the plurality of anchors. Each of the traction nubs has a lower portion and an upper portion. The lower portion includes a threaded lower end and a circular upper end. The threaded lower end couples with the threaded aperture of the plurality of anchors. The circular upper end has a hexagonal shaped recess formed therein. The upper portion of the nubs are comprised of a soft rubber material disposed over the circular upper end of the lower portion. A tool is provided for installing and removing the plurality of traction nubs with respect to the plurality of anchors. The tool has a generally L-shaped configuration. The tool has a first end portion that is adapted for engaging the hexagonal shaped recesses of the traction nubs for removal of the traction nubs. The tool has a second end portion having an arcuate segment disposed thereon for engaging the upper portion of the traction nubs for installing the traction nubs.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shoe with replaceable traction nubs which has all the advantages of the prior art foot wear and none of the disadvantages.

It is another object of the present invention to provide a new and improved shoe with replaceable traction nubs which may be easily and efficiently manufactured and marketed.

It is a further object of the present invention to provide a new and improved shoe with replaceable traction nubs which is of durable and reliable construction.

An even further object of the present invention is to provide a new and improved shoe with replaceable traction nubs which is susceptible of a low cost of manufacture with regard to both materials and labor, and which accordingly is then susceptible of low prices of sale to the consuming public, thereby making such a shoe with replaceable traction nubs economically available to the buying public.

Even still another object of the present invention is to provide a new and improved shoe with replaceable traction nubs for allowing proper traction to be maintained throughout a life of the shoe.

Lastly, it is an object of the present invention to provide a new and improved shoe with replaceable traction nubs including a shoe comprised of an upper portion and a sole portion. The sole portion is disposed on a lower surface of the upper portion. The sole portion has a plurality of openings formed therein in a spaced relationship. A plurality of anchors are secured within the plurality of openings in the sole portion. A plurality of traction nubs are removably secured to the plurality of anchors. A tool is provided for installing and removing the plurality of traction nubs with respect to the plurality of anchors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
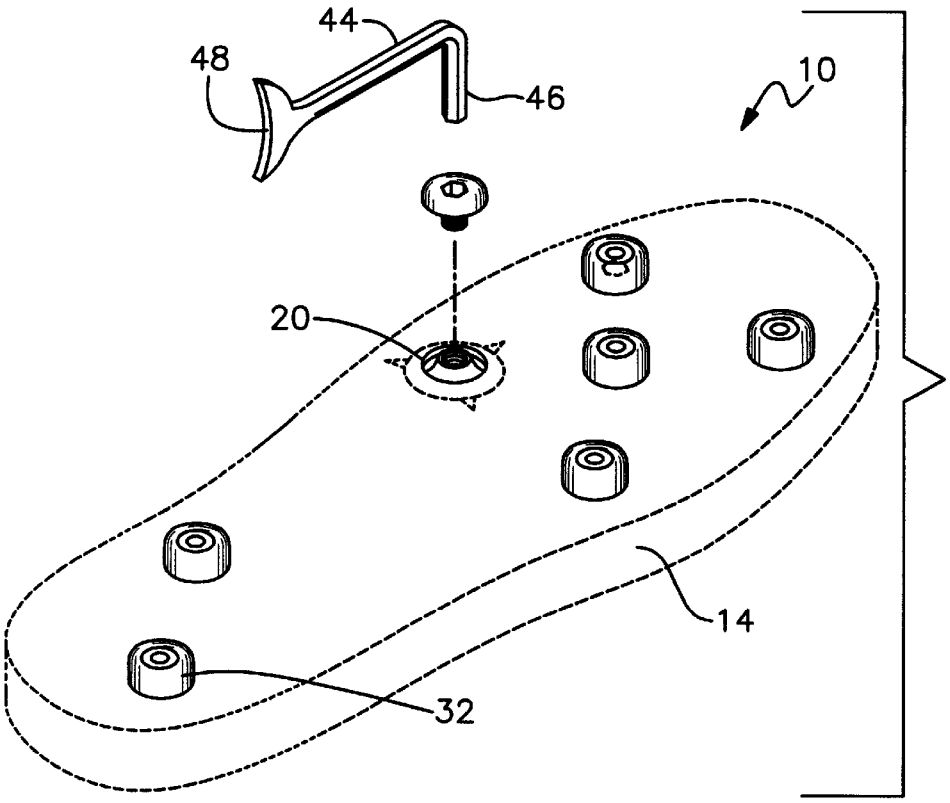
FIG. 1 is a perspective view of the preferred embodiment of the shoe with replaceable traction nubs constructed in accordance with the principles of the present invention.
Figure 2:
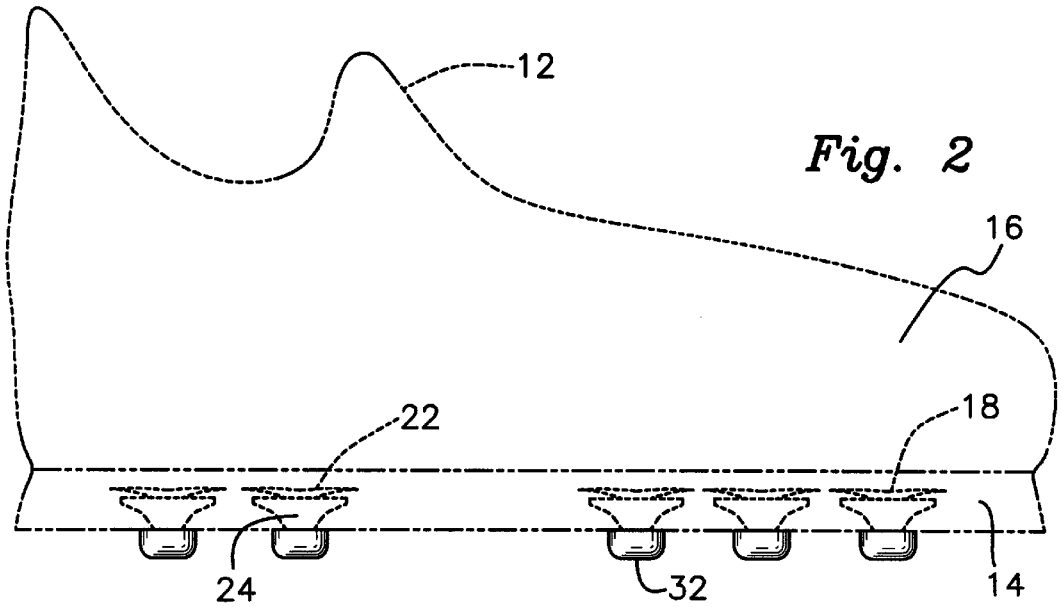
FIG. 2 is a side elevation view of the present invention.
Figure 3:
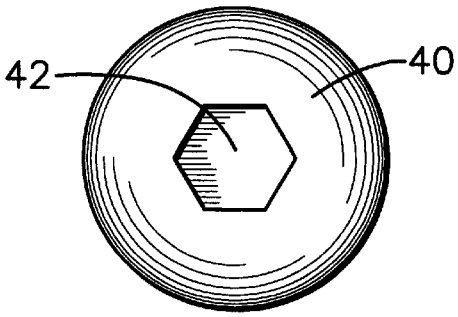
FIG. 3 is top view of the stud portion of the replaceable nub.
Figure 4:
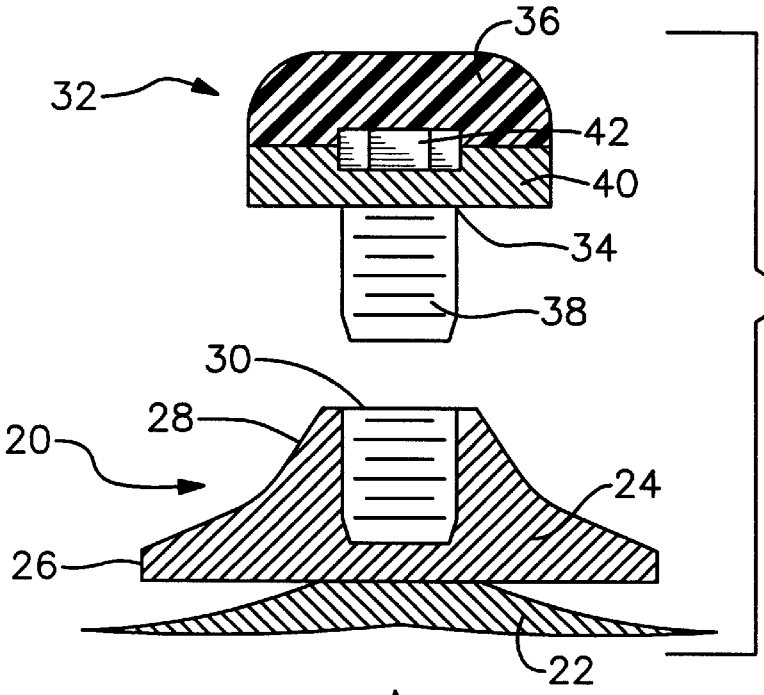
FIG. 4 is cross-sectional side view of the replaceable nub and the anchor of the present invention.
Figure 5:
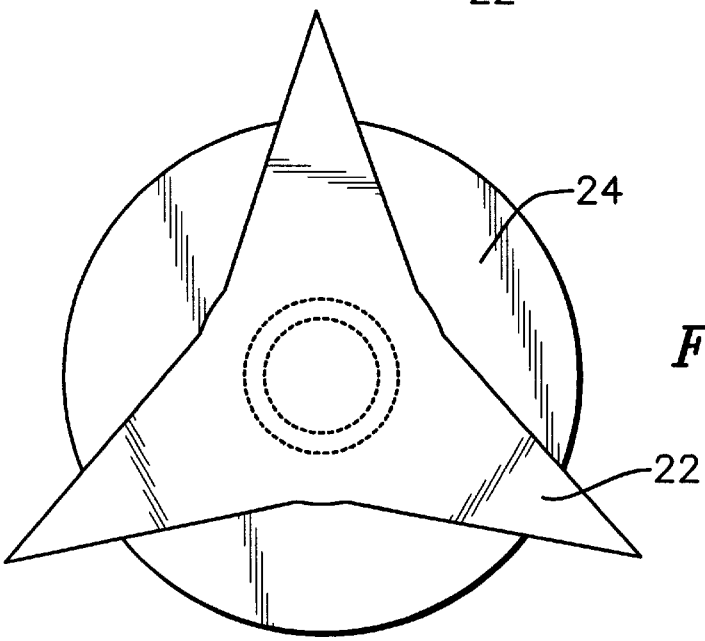
FIG. 5 is bottom plan view of the anchor of the present invention.

With reference now to the drawings, and in particular, to FIGS. 1 through 5 thereof, the preferred embodiment of the new and improved shoe with replaceable traction nubs embodying the principles and concepts of the present invention and generally designated by the reference number 10 will be described.

Specifically, it will be noted in the various Figures that the device relates to a shoe with replaceable traction nubs for allowing proper traction to be maintained throughout a life of the shoe. In its broadest context, the device consists of a shoe, a plurality of anchors, a plurality of traction nubs and a tool. Such components are individually configured and correlated with respect to each other so as to attain the desired objective.

The shoe 12 is comprised of an upper portion 16 and a sole portion 14. The sole portion 14 is disposed on a lower surface of the upper portion 16. The sole portion 14 has a plurality of openings 18 formed therein in a spaced relationship.

The plurality of anchors 20 are secured within the plurality of openings 18 in the sole portion 14. Each of the anchors 20 has a triangular shaped base 22 secured within the openings 18. Each of the anchors 20 has a coupling portion 24 extending upwardly from the triangular shaped base 22. The coupling portion 24 has a wide rounded lower portion 26 and a tapered upper portion 28. The tapered upper portion 28 has a threaded aperture 30 formed within an upper end thereof. The upper end extends outwardly of the opening 18 in the sole portion 14.

The plurality of traction nubs 32 are removably secured to the plurality of anchors 20. Each of the traction nubs 32 has a lower portion 34 and an upper portion 36. The lower portion 34 includes a threaded lower end 38 and a circular upper end 40. The threaded lower end 38 couples with the threaded aperture 30 of the plurality of anchors 20. The circular upper end 40 has a hexagonal shaped recess 42 formed therein. The upper portion 36 of the nubs 32 are comprised of a soft rubber material disposed over the circular upper end 40 of the lower portion 34.

The tool 44 is provided for installing and removing the plurality of traction nubs 32 with respect to the plurality of anchors 20. The tool 44 has a generally L-shaped configuration. The tool 44 has a first end portion 46 that is adapted for engaging the hexagonal shaped recesses 42 of the traction nubs 32 for removal of the traction nubs 32 from the sole portion 14. The tool 44 has a second end portion 48 having an arcuate segment disposed thereon for engaging the upper portion 36 of the traction nubs 32 for installing the traction nubs 32.

The present invention are replaceable traction nubs 32 that are incorporated into the production and marketing of athletic footwear. The traction nubs 32 are made to be inserted into the anchors 20 in the sole portion 14 of the shoe 12. When the traction nubs 32 are worn down, they can be easily removed and replaced, to allow a user to maintain excellent traction and shock absorption throughout the life of the shoe 12. When installed, the lower portion 34 rest within the anchors with the upper portions 36 protruding slightly from the sole portion 14. Once the traction nubs wear down to a defined level, the hexagonal shaped recesses 42 will be exposed to inform the user that it is time for their replacement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A shoe with replaceable traction nubs for allowing proper traction to be maintained throughout a life of the shoe comprising, in combination:

a shoe comprised of an upper portion and a sole portion, the sole portion being disposed on a lower surface of the upper portion, the sole portion having a plurality of openings formed therein in a spaced relationship;

a plurality of anchors secured within the plurality of openings in the sole portion, each of the anchors having a triangular shaped base secured within the openings, each of the anchors having a coupling portion extending upwardly from the triangular shaped base, the coupling portion having a wide rounded lower portion and a tapered upper portion, the tapered upper portion having a threaded aperture formed within an upper end thereof, the upper end extending outwardly of the opening in the sole portion;

a plurality of traction nubs removably secured to the plurality of anchors, each of the traction nubs having a lower portion and an upper portion, the lower portion including a threaded lower end and a circular upper end, the threaded lower end coupling with the threaded aperture of the plurality of anchors, the circular upper end having a hexagonal shaped recess formed therein, the upper portion of the nubs being comprised of a soft rubber material disposed over the circular upper end of the lower portion; and a tool for installing and removing the plurality of traction nubs with respect to the plurality of anchors, the tool having a generally L-shaped configuration, the tool having a first end portion adapted for engaging the hexagonal shaped recesses of the traction nubs for removal of the traction nubs, the tool having a second end portion having an arcuate segment disposed thereon for engaging the upper portion of the traction nubs for installing the traction nubs.

2. A shoe with replaceable traction nubs for allowing proper traction to be maintained throughout a life of the shoe comprising, in combination:

a shoe comprised of an upper portion and a sole portion, the sole portion being disposed on a lower surface of the upper portion, the sole portion having a plurality of openings formed therein in a spaced relationship;

a plurality of anchors secured within the plurality of openings in the sole portion;

a plurality of traction nubs removably secured to the plurality of anchors; and a tool for installing and removing the plurality of traction nubs with respect to the plurality of anchors;

wherein each of the traction nubs has a lower portion and an upper portion, the lower portion including a threaded lower end and a circular upper end, the threaded lower end coupling with the plurality of anchors, the circular upper end having a hexagonal shaped recess formed therein, the upper portion of the nubs comprising a soft rubber material disposed over the circular upper end of the lower portion.

3. The shoe with replaceable traction nubs as set forth in claim 2 wherein each of the anchors has a triangular shaped base secured within the openings, each of the anchors has a coupling portion extending upwardly from the triangular shaped base, the coupling portion has a wide rounded lower portion and a tapered upper portion, the tapered upper portion has a threaded aperture formed within an upper end thereof, the upper end extending outwardly of the opening in the sole portion for coupling with the plurality of nubs.

4. The shoe with replaceable traction nubs as set forth in claim 2 wherein the tool has a generally L-shaped configuration, the tool has a first end portion adapted for engaging interior portions of the traction nubs for removal of the traction nubs, the tool has a second end portion having an arcuate segment disposed thereon for engaging an upper portion of the traction nubs for installing the traction nubs.

* * * * *